US012339030B2

(12) United States Patent
Xing et al.

(10) Patent No.: US 12,339,030 B2
(45) **Date of Patent: *Jun. 24, 2025**

(54) AIR OUTLET DEVICE AND AIR CONDITIONING APPARATUS

(71) Applicant: GD MIDEA AIR-CONDITIONING EQUIPMENT CO., LTD., Foshan (CN)

(72) Inventors: Zhigang Xing, Foshan (CN); Ali Zhao, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 100 days.

This patent is subject to a terminal disclaimer.

(21) Appl. No.: 18/244,612

(22) Filed: Sep. 11, 2023

(65) Prior Publication Data

US 2023/0417448 A1 Dec. 28, 2023

Related U.S. Application Data

(63) Continuation of application No. 16/979,431, filed as application No. PCT/CN2020/084376 on Apr. 13, 2020, now Pat. No. 11,796,216.

(30) Foreign Application Priority Data

Nov. 29, 2019 (CN) ..... 201911218774.0
Nov. 29, 2019 (CN) ..... 201922132569.4

(51) Int. Cl.
*F24F 13/065* (2006.01)

(52) U.S. Cl.
CPC ..... *F24F 13/065* (2013.01)

(58) Field of Classification Search
CPC ..... F24F 13/065
(Continued)

(56) References Cited

U.S. PATENT DOCUMENTS 3,103,155 A 9/1963 Boylan et al.
3,662,668 A 5/1972 Johnson
(Continued)

FOREIGN PATENT DOCUMENTS

CN 202209758 U 5/2012
CN 202734074 U 2/2013
(Continued)

OTHER PUBLICATIONS

The China National Intellectual Property Administration (CNIPA) the First Office Action for Chinese Application 201911218774.0 Sep. 3, 2024 14 Pages (With Translation).
(Continued)

*Primary Examiner* — Allen R. B. Schult
(74) *Attorney, Agent, or Firm* — Anova Law Group, PLLC

(57) ABSTRACT

An air outlet device includes an air duct case, a driver, and air guide assemblies. The air duct case includes an air outlet member including an air cavity, an air inlet at one side of the air outlet member and communicating with the air cavity, and air outlets at another side of the air outlet member and communicating with the air cavity. Each of the air guide assemblies includes an air outlet hole, and is movably mounted at the air outlet member and located at a corresponding one of the air outlets. The air guide assemblies are provided close to a surface of the air outlet member and are movable along the surface of the air outlet member to change an angle of an airflow from the corresponding one of the air outlets. The air guide assemblies are driven and controlled separately by the driver.

16 Claims, 8 Drawing Sheets

(58) Field of Classification Search
USPC ..... 454/155
See application file for complete search history.

(56) References Cited

U.S. PATENT DOCUMENTS

| | | | | |
|---|---|---|---|---|
| 5,733,191 | A | 3/1998 | Lam et al. | |
| 11,796,216 | B2 * | 10/2023 | Xing | F24F 1/0011 |

FOREIGN PATENT DOCUMENTS

| | | | |
|---|---|---|---|
| CN | 105517821 | A | 4/2016 |
| CN | 106016650 | A | 10/2016 |
| CN | 106225089 | A | 12/2016 |
| CN | 206222464 | U | 6/2017 |
| CN | 109520104 | A | 3/2019 |
| CN | 109945302 | A | 6/2019 |
| CN | 110285561 | A | 9/2019 |
| CN | 110748978 | A | 2/2020 |
| CN | 110749080 | A | 2/2020 |
| CN | 211177365 | U | 8/2020 |
| DE | 3403084 | C1 | 6/1985 |
| EP | 0195343 | A1 | 9/1986 |
| EP | 0393440 | A1 | 10/1990 |
| EP | 3015776 | A1 | 5/2016 |
| EP | 3040627 | A1 | 7/2016 |
| EP | 3091296 | A1 | 11/2016 |
| EP | 3376123 | A1 | 9/2018 |
| FR | 2673271 | A1 | 8/1992 |
| FR | 2886383 | A1 | 12/2006 |
| JP | 2013024514 | A | 2/2013 |
| JP | 2017043141 | A | 3/2017 |
| JP | 6561682 | B2 | 8/2019 |
| JP | 6561683 | B2 | 8/2019 |
| KR | 20180050851 | A | 5/2018 |
| KR | 20180089748 | A | 8/2018 |

OTHER PUBLICATIONS

The European Patent Office (EPO) Communication pursuant to Article 94(3) EPC for EP Application No. 20768240.2, Nov. 30, 2023 8 Pages.

The China National Intelleectual Property Administration (CNIPA) the First Office Action for 202011203033.8, Aug. 25, 2021 12 Pages (With Translation).

The European Patent Office (EPO) Extended Search Report for EP Application No. 20768240.2, Aug. 31, 2021 9 Pages.

World Intellectual Property Organization (WIPO) International Search Report and Written Opinion for PCT/CN2020/084376 Aug. 10, 2020 18 Pages.

Canadian Intellectual Property Office the Office Action for CA Application No. 3123492 Sep. 20, 2022 6 Pages.

* cited by examiner

AIR OUTLET DEVICE AND AIR CONDITIONING APPARATUS

CROSS-REFERENCE TO RELATED APPLICATIONS

This application is a continuation of U.S. application Ser. No. 16/979,431, filed on Sep. 9, 2020, which is a National Stage Entry under 35 U.S.C. § 371 of International Application No. PCT/CN2020/084376, filed Apr. 13, 2020, which claims priority to Chinese Patent Application No. 201911218774.0, entitled "Air Outlet Device And Air Conditioning Apparatus" and filed on Nov. 29, 2019, and Chinese Patent Application No. 201922132569.4, entitled "Air Outlet Device And Air Conditioning Apparatus" and filed on Nov. 29, 2019, the entire contents of all of which are incorporated herein by reference.

TECHNICAL FIELD

This application relates to the field of air conditioning technology, and in particular to an air outlet device and an air conditioning apparatus having the air outlet device.

BACKGROUND

Air conditioning apparatus is now a relatively important electrical appliance in people's home life. When the air outlet angle of the existing air conditioning apparatus is adjusted, the wind is usually directed in different directions through the swing of the louvers, which is likely to cause greater wind resistance.

SUMMARY

The main object of this application is to provide an air outlet device, which aims to reduce the wind resistance during the air outlet process of the air conditioning apparatus.

In order to achieve the above object, this application provides an air outlet device, including:

an air duct case, including an air outlet member including an air cavity formed therein, an air inlet on one side of the air outlet member and communicating with the air cavity on one side, and an air outlet on the other side of the air outlet member and communicating with the air cavity on the other side; and an air guide assembly, including an air outlet hole, movably mounted at the air outlet member and located at the air outlet, the air guide assembly being provided close to a surface of the air outlet member and being movable along the surface of the air outlet member to change an angle of air blown out from the air outlet.

Optionally, the air guide assembly is received in the air cavity and movable along an inner surface having the air outlet of the air outlet member.

Optionally, at least two air outlets are formed on the air outlet member, and one air outlet is correspondingly provided with one air guide assembly.

Optionally, the air outlet member includes a curved case with an arched cross-section, end covers covering two ends of the curved case, and a base plate covering a lateral opening of the curved case. The air outlet is formed at the curved case. The air inlet is formed at the base plate. The air guide assembly includes an air guide member facing the air outlet. The air outlet hole is formed at the air guide member.

A cross-sectional shape of the air guide member is an arc shape matching a shape of the curved case.

Optionally, the air guide member includes a shielding area and an air outlet area, and the air outlet hole is formed at the air outlet area.

Optionally, the air outlet area includes a grille to form the air outlet hole. The grille extends in a length direction of the air outlet. When the air guide assembly moves along the surface of the air outlet member, a direction of airflow entering the air cavity from the air inlet is set at an acute angle with a plate surface of the base plate, and an included angle between a plate surface of the grille and a horizontal plane is between 0 degrees and 90 degrees.

Optionally, the air guide member includes two shielding areas each provided at one of front and rear sides along a moving direction of the air guide member, and the air outlet area is located between the two shielding areas.

Optionally, the air outlet device further includes a driver mounted at an outer side of at least one of the end covers. The air guide assembly further includes a connection member connected to an end of the air guide member. A driving shaft of the driver is connected to the connection member.

This application further provides an air conditioning apparatus, which includes an air blower and the air outlet device described above. An outlet of the air blower is in communication with the air inlet.

Optionally, the air duct case further includes a mounting member integrated with the air outlet member. The air blower is mounted to the mounting member.

According to the technical solution of this application, an air cavity is formed inside an air outlet member, and airflow entering from an air inlet is gathered inside the air cavity. An air guide assembly is provided close to a surface of the air outlet member. The air guide assembly may move along the surface of the air outlet member, so that a relative position of an air outlet hole is also changed, which causes an angle of air blown from the air outlet to change, so as to meet the needs of people for different air outlet angles. Because the air guide assembly is provided close to the surface of the air outlet member and moves along the surface of the air outlet member, the air guide assembly may be equivalent to a part of a case of the air outlet member during the air guide process. The airflow accumulated in the air cavity suffers from a very small wind resistance of the air guide assembly, thus realizing the maximum air output.

BRIEF DESCRIPTION OF THE DRAWINGS

In order to more clearly describe the technical solutions in the embodiments of this application or the existing technology, the following will briefly introduce the drawings used in the description of the embodiments or the existing technology. Obviously, the drawings in the following description are only some embodiments of this application. For those of ordinary skill in the art, without creative work, other drawings can be obtained according to the structure shown in these drawings.

Figure 1:
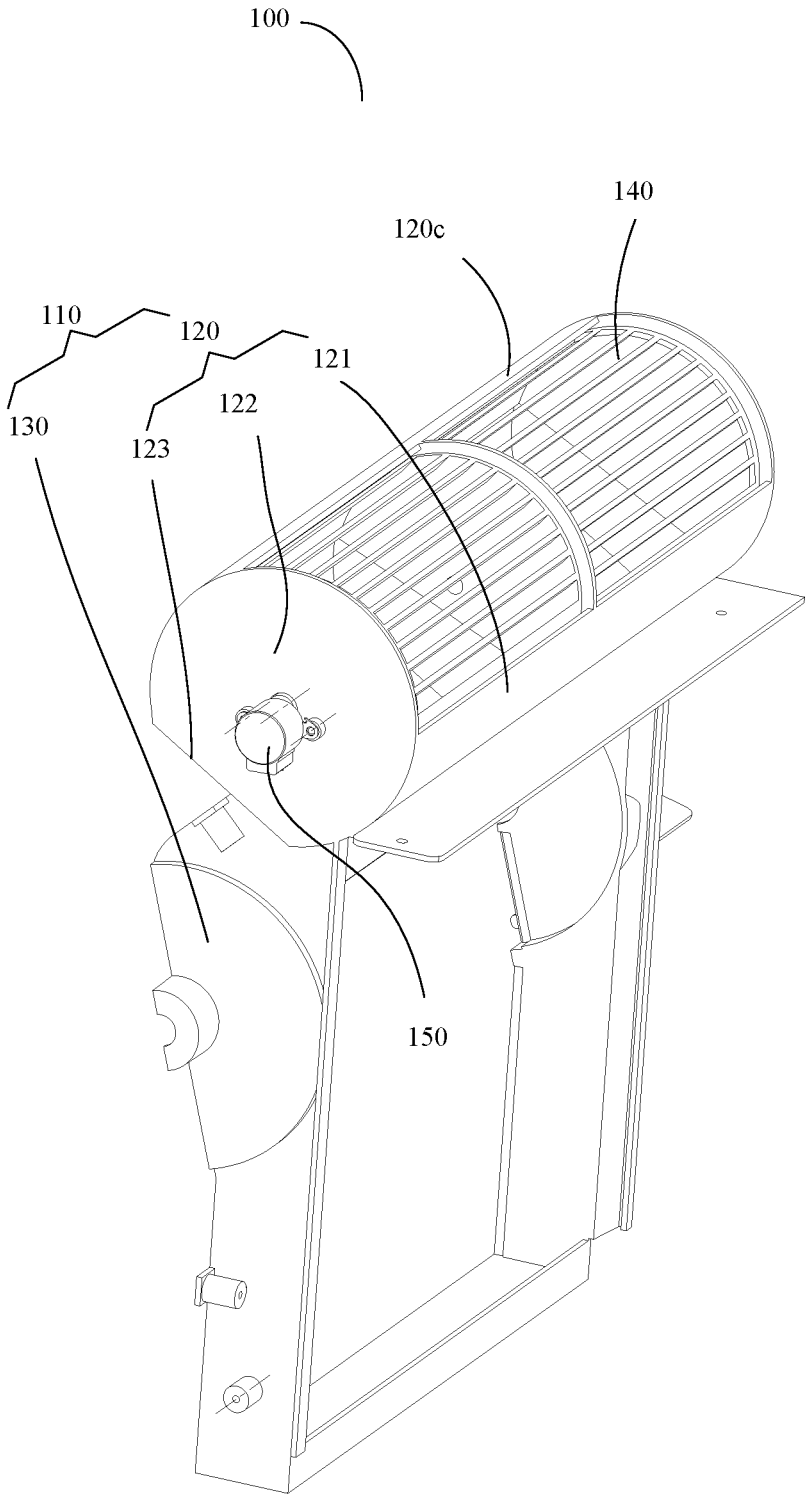
FIG. 1 is a schematic three-dimensional structural diagram of an air outlet device according to an embodiment of this application.

The realization of the object, function characteristics, and advantages of this application will be further described in connection with the embodiments and with reference to the accompanying drawings.

DETAILED DESCRIPTION OF THE EMBODIMENTS

The technical solutions in the embodiments of this application will be described clearly and completely in connection with the drawings in the embodiments of this application. Obviously, the described embodiments are only some of the embodiments of this application, but not all the embodiments. Based on the embodiments in this application, all other embodiments obtained by those of ordinary skill in the art without creative work shall fall within the scope of this application.

It should be noted that all directional indicators (such as up, down, left, right, front, back . . . ) in the embodiments of this application are only used to explain the relative positional relationship, movement conditions, etc. among the components in a specific posture (as shown in the drawings), if the specific posture changes, the directional indicator also changes accordingly.

In this application, unless otherwise clearly specified and limited, the terms "connected," "fixed," etc. should be understood in a broad sense. For example, "fixed" can be a fixed connection, a detachable connection, or a whole; it can be a mechanical connection or an electrical connection; it can be a direct connection or an indirect connection through an intermediate medium, and it can be the internal communication between two components or the interaction relationship between two components, unless specified otherwise. For those of ordinary skill in the art, the specific meanings of the above-mentioned terms in this application can be understood according to specific circumstances.

In addition, the descriptions related to "first," "second," etc. in this application are for descriptive purposes only, and should not be understood as indicating or implying their relative importance or implicitly indicating the number of indicated technical features. Thus, the features associated with "first" and "second" may include at least one such feature either explicitly or implicitly. In addition, the technical solutions between the various embodiments can be combined with each other, but they must be based on the ability of those skilled in the art to realize. When the combination of technical solutions conflicts with each other or cannot be realized, it should be considered that the combination of such technical solutions does not exist, and is not within the scope of this application.

This application provides an air outlet device 100.

Figure 2:
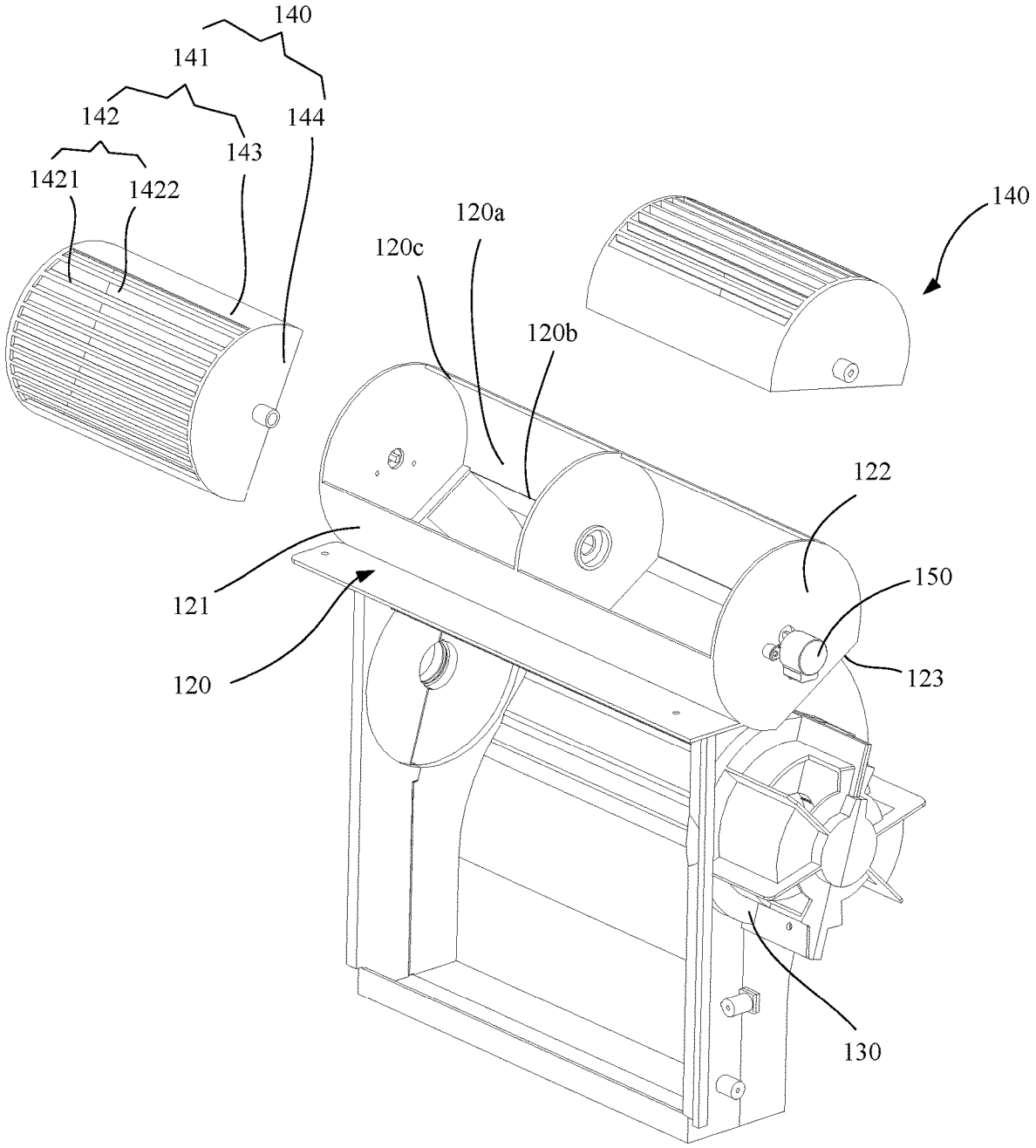
FIG. 2 is a schematic explosive structural diagram of a structure of the air outlet device in FIG. 1.
Figure 3:
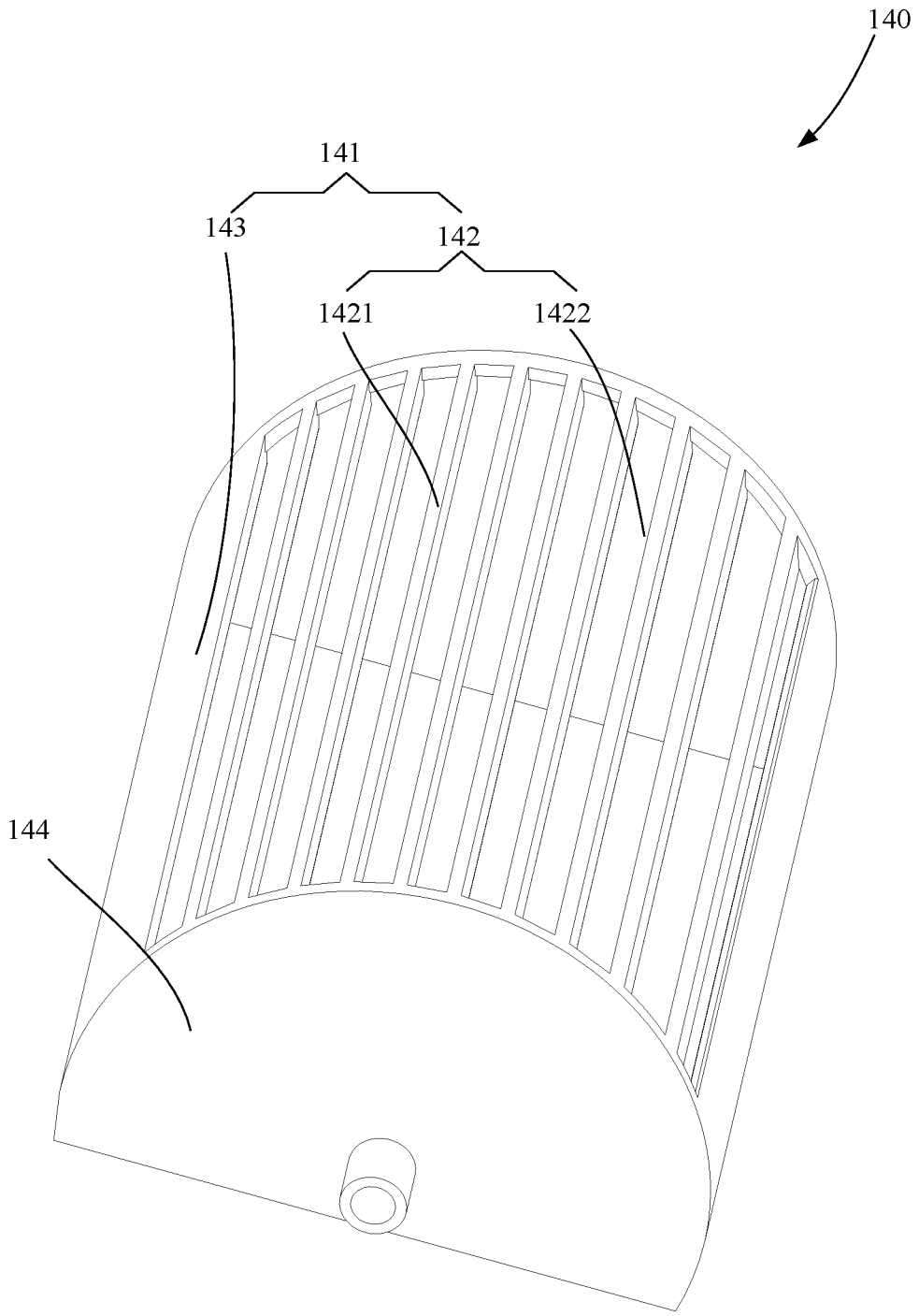
FIG. 3 is a schematic three-dimensional structural diagram structure of an air guide assembly in the air outlet device of this application.

Referring to FIGS. 1 to 3, in an embodiment of this application, the air outlet device 100 includes an air duct case 110 and an air guide assembly 140. The air duct case 110 includes an air outlet member 120 which has an air cavity 120*a* formed therein. An air inlet 120*b* in communication with the air cavity 120*a* is formed at one side of the air outlet member 120, and an air outlet 120*c* in communication with the air cavity 120*a* is formed at the other side of the air outlet member 120. The air guide assembly 140 includes an air outlet hole 1422. The air guide assembly 140 is movably mounted at the air outlet member 120 and is located at the air outlet 120*c*. The air guide assembly 140 is provided close to a surface of the air outlet member 120 and may move along the surface of the air outlet member 120 to change an angle of air blown out from the air outlet 120*c*.

The air outlet device 100 of this application is applied to an air conditioning apparatus 500. The air outlet member 120 as a whole extends along an axis in an elongated strip shape, and the air inlet 120*b* and the air outlet 120*c* also extend in a length direction of the air outlet member 120 in an elongated opening shape. The air guide assembly 140 is also in an elongated shape, so as to be adapted to the entire air outlet member 120 to interfere with an air outlet angle of the entire air outlet 120*c*. The air guide assembly 140 is provided close to the surface of the air outlet member 120 and may move along the surface of the air outlet member 120, that is, the air guide assembly 140 may slide relative to the surface of the air outlet member 120. In addition, the air guide assembly 140 may be provided on an inner side or an outer side of the air outlet member 120, that is, the air guide assembly 140 may slide relative to an inner surface or an outer surface of the air outlet member 120. The air guide assembly 140 may be manually or automatically driven to slide. When the air guide assembly 140 is manually driven, a sliding guide structure with a sliding rail cooperating with a sliding groove may be formed on the air guide assembly 140 and the air outlet member 120, and the air guide assembly 140 may be provided with a lever for turning the air guide assembly 140 to rotate. Or, when the air guide assembly 140 and the air outlet member 120 form a rotating shaft connection, the air guide assembly 140 may be driven to slide relative to the air guide member 141 through a rocker or a knob. In this application, the air inlet 120*b* is correspondingly connected to an outlet of a blower or an outlet of an air duct of the air conditioning apparatus 500. The airflow enters the air cavity 120*a* from the air inlet 120*b* and is accumulated in the air cavity 120*a*. The air guide assembly 140 includes the air outlet hole 1422, and a position of the air outlet hole 1422 relative to the air outlet 120*c* or the air inlet 120*b* will inevitably change during the movement of the air guide assembly 140, which will cause an angle of airflow blown out from the air outlet 120*c* to change. The airflow discharged from the air outlet 120*c* may be used to achieve indoor cooling, indoor purification, or other scenes where needed.

In the technical solution of this application, an air cavity 120*a* is formed inside an air outlet member 120, and airflow entering from an air inlet 120*b* is gathered inside the air cavity 120*a*. An air guide assembly 140 is provided close to a surface of the air outlet member 120. The air guide assembly 140 may move along the surface of the air outlet member 120, so that a relative position of an air outlet hole 1422 is also changed, which causes an angle of air blown from the air outlet 120*c* to change, so as to meet the needs of people for different air outlet angles. Because the air guide assembly 140 is provided close to the surface of the air outlet member 120 and moves along the surface of the air outlet member 120, the air guide assembly 140 may be equivalent to a part of a case of the air outlet member 120 during the air guide process. The airflow accumulated in the air cavity 120*a* suffers from a very small wind resistance of the air guide assembly 140, thus realizing the maximum air output.

In this application, the air guide assembly 140 is received in the air cavity 120*a* and may move along an inner surface of the air outlet member 120 where the air outlet 120*c* is formed. In this application, the air guide assembly 140 is built in the air outlet member 120, so that the air guide assembly 140 may serve as an inner wall of the air outlet member 120 during the air guide process. On the one hand, the built-in structure makes it difficult for dust and other sundries to be accumulated between the air guide assembly 140 and the air outlet member 120. On the other hand, the built-in structure also makes the air conditioning apparatus 500 with the structure of this application more integrated and more beautiful in appearance. It can be understood that it is also possible to arrange the air guide assembly 140 outside the air outlet member 120, which may make the disassembly and assembly of the air guide assembly 140 easier.

Please refer to FIGS. 1 to 3 in combination again, the air outlet member 120 includes a curved case 121 with an arched cross-section, end covers 122 covering both ends of the curved case 121, and a base plate 123 covering a lateral opening of the curved case 121. The air outlet 120*c* is formed at the curved case 121, and the air inlet 120*b* is formed at the base plate 123. The air guide assembly 140 includes an air guide member 141 facing the air outlet 120*c* and defining the air outlet hole 1422. A cross-sectional shape of the air guide member 141 is an arc shape that matches a shape of the curved case 121.

In this application, an arc angle of a cross section of the curved case 121 is approximately 270 degrees, and an opening angle of the air outlet 120*c* is approximately 90 degrees to 100 degrees. The curved case 121, the end covers 122 and the base plate 123 enclose to form the air cavity 120*a*. An overall shape of the air outlet member 120 is a cylindrical shape with a part cut off in an axial direction, so that the air cavity 120*a* also has an inner wall that can make the air flow swirl. The entire air outlet member 120 is located at an end of the air outlet device 100, and when the air outlet device 100 is placed vertically, the air outlet member 120 is located at a top end. In the actual use process, it can be known that air flow blown from the air inlet 120*b* on the base plate 123 will rush toward the curved case 121. When the air flow hits the inner wall of the curved case 121, the air flow is guided to the air outlet hole 1422 by the inner wall of the curved case 121 and blown out from the air outlet 120*c*. It can be understood that when the airflow is guided by the inner wall of the curved case 121, the less is the guide distance and the less does the airflow direction change, the faster the flow rate of the airflow blown from the air outlet hole 1422 is. It is obvious that since the air guide member 141 of the air guide assembly 140 is provided close to the inner wall of the curved case 121, it may be regarded as a part of the inner wall of the curved case 121, so the process when the airflow is guided is smoother. Compared with the way in which the louver is set at the air outlet 120*c* to obstruct the air flow again and change the direction of the air flow, the wind resistance in this application will be relatively smaller and the air outlet volume will be much larger. It should be noted that the shape and structure of the air outlet member 120 may be other shapes and structures, such as an elliptical shape, a square shape, or other anisotropic shapes, besides the embodiments listed above.

Further, during the use of the air conditioning apparatus 500, people's needs for air output will vary depending on the region or time of use. For example, if a rapid cooling is wanted, a large amount of air and a large air speed are needed; if a mild air conditioning is wanted, the air outlet volume needs to be reduced. For this reason, in this application, the air guide member 141 includes a shielding area 143 and an air outlet area 142. The air outlet area 142 may be corresponding to the air outlet 120*c* when larger air volume is needed, and the shielding area 143 may cover part of the air outlet 120*c* when smaller air volume is needed.

Further, this application may further realize the control of the air outlet angle under the condition that the control of the air outlet volume may be realized. Please refer to FIGS. 4 to 6 in combination, the air outlet area 142 is provided with a grille 1421 to define air outlet holes 1422. The grille 1421 extends in a length direction of the air outlet 120*c*. When the air guide assembly 140 moves along the inner surface of the air outlet member 120, an angle between a plate surface of the grille 1421 and the horizontal plane is between 0 degrees and 90 degrees.

Figure 4:
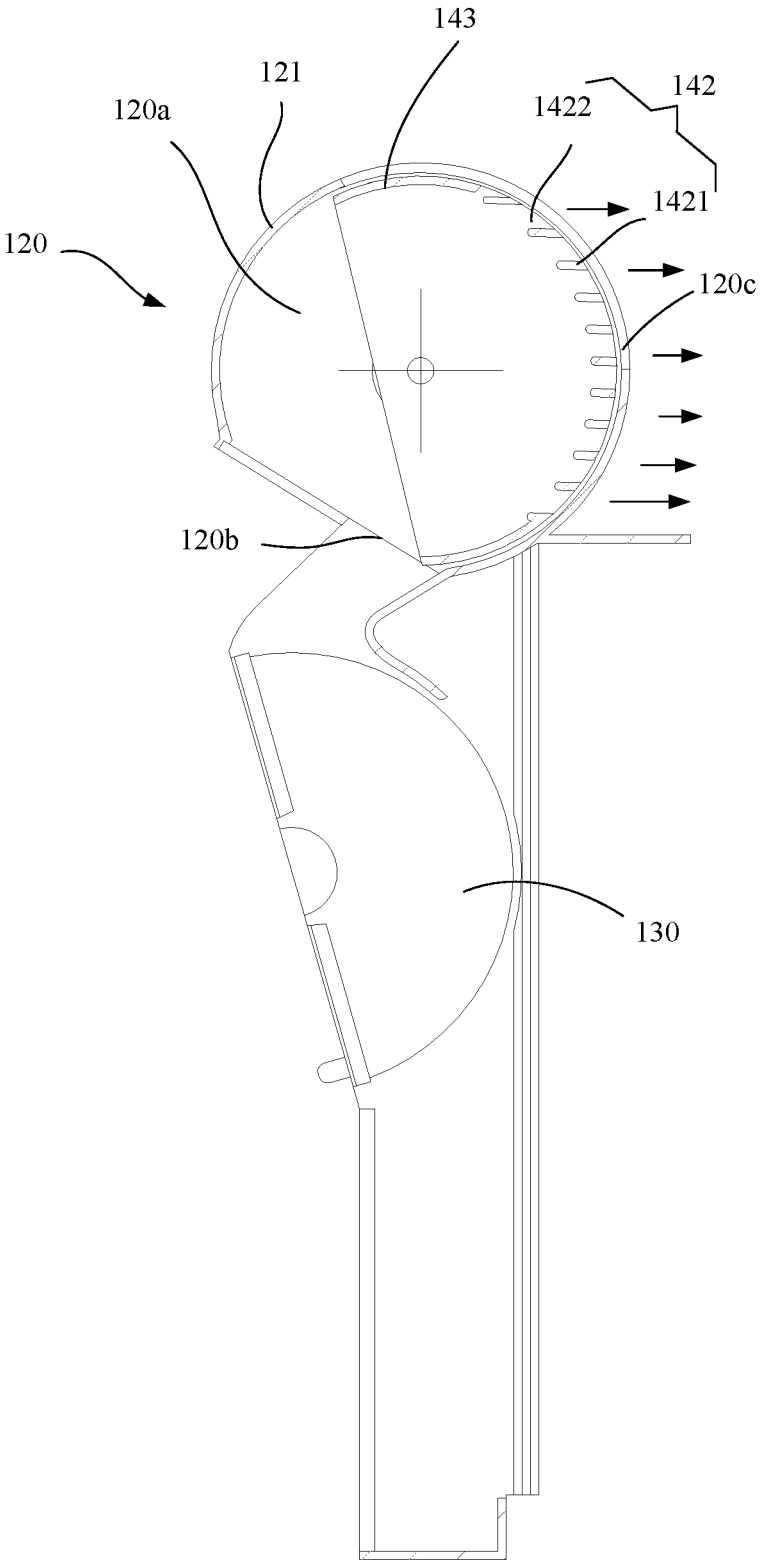
FIG. 4 is a cross-sectional view of the air outlet device of this application in a front air outlet mode.

In this application, a plurality of grilles 1421 are provided and arranged at even intervals. Each grille 1421 is in a shape of a flat strip and has two opposite surfaces. A strip-shaped air outlet hole 1422 is defined between the two opposite surfaces of adjacent grilles 1421. A direction of initial airflow entering the air cavity 120*a* from the air inlet 120*b* is set at an acute angle with a plate surface of the base plate 123 (specifically, it can be achieved through adjustment of an angle of a volute and a volute tongue installed on the air duct case 110). In this way, when the air guide assembly 140 moves along the surface of the air outlet member 120, the front air outlet, oblique air outlet, and top air outlet modes may be realized. The specific implementation process is as follows:

Please refer to FIG. 4. FIG. 4 is a cross-sectional view of the air outlet device 100 of this application in a front air outlet mode. The air outlet device 100 of this application is placed vertically during actual use. At this time, the curved case 121 is tilted towards the user, so that the opening direction of the air outlet 120*c* when in use is approximately 40 degrees to 50 degrees from the horizontal plane. The air guide member 141 is rotated and moved clockwise in the figure, and the air outlet area 142 is approximately located at a lower part of the air outlet 120*c*, so that surfaces of the grilles 1421 may be parallel to the horizontal plane. At this time, the passages of the air outlet holes 1422 among the grilles 1421 are also horizontally arranged. Because the initial airflow entering the air cavity 120*a* from the air inlet 120*b* is arranged at an acute angle and faces the lower part of the air outlet 120*c*, most of the airflow may be directly blown forward from the passages of the horizontal air outlet holes 1422 (the arrow in FIG. 4 is the direction of the airflow), so that airflow with a high volume and high speed may be formed in front of the outside of the air outlet device 100, thereby achieving the effect of rapid temperature adjustment.

Figure 5:
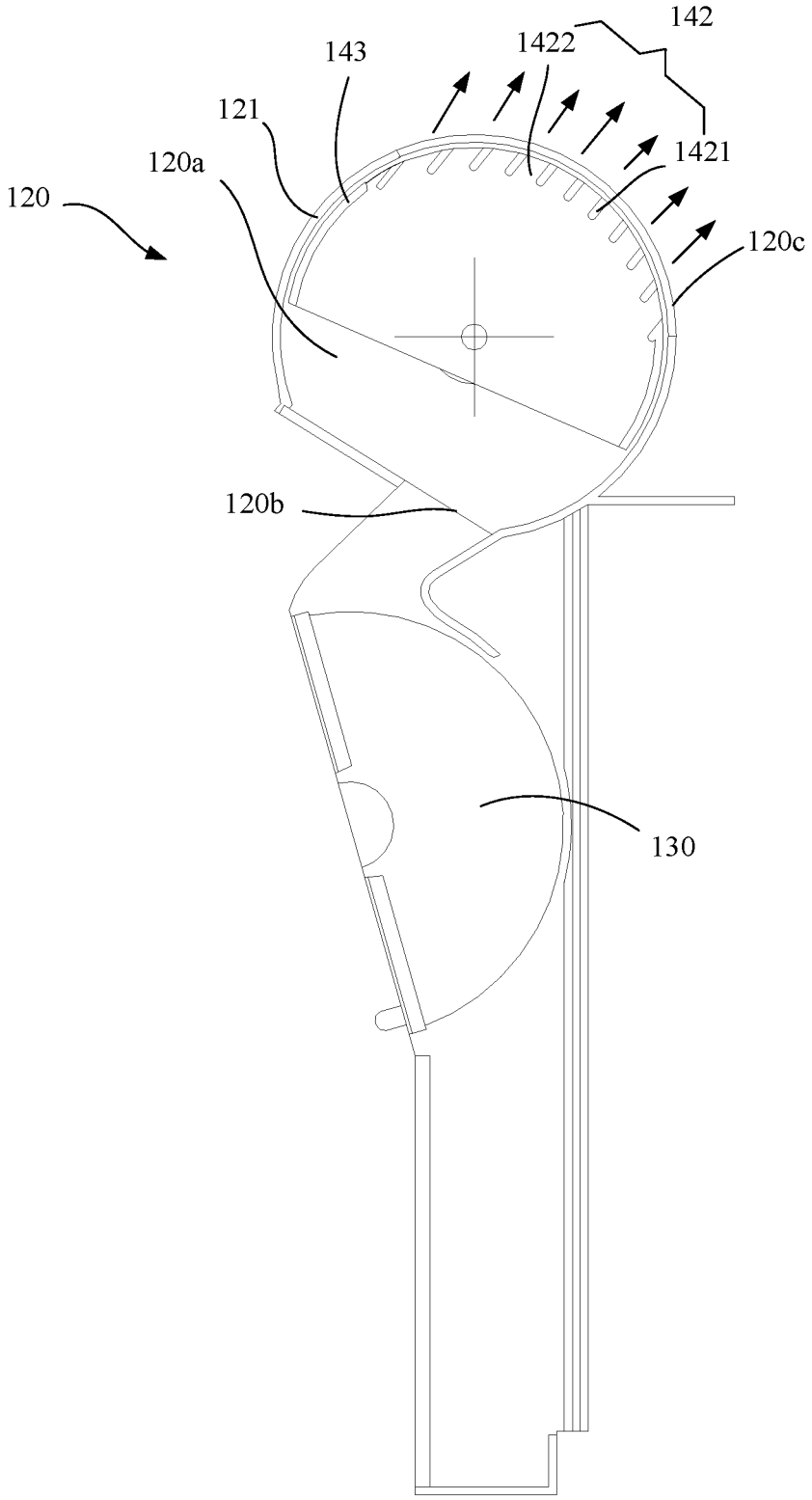
FIG. 5 is a cross-sectional view of the air outlet device of this application in an oblique air outlet mode.

Please refer to FIG. 5. FIG. 5 is a cross-sectional view of the air outlet device 100 of this application in an oblique air outlet mode. In this mode, the air guide member 141 is rotated and moved counterclockwise in the figure. At this time, the air outlet area 142 is approximately located in the middle of the air outlet 120*c*, and the passages of the air outlet holes 1422 among the grilles 1421 are approximately 45 degrees to 60 degrees from the horizontal plane. Because the initial airflow entering the air cavity 120*a* from the air inlet 120*b* is arranged at an acute angle to the plate surface of the base plate 123 and faces the lower part of the air outlet 120*c*, the air flow will be guided by the inner wall of the air cavity 120*a* to the air outlet holes 1422 in the inclined state, thereby blowing out the airflow in the inclined state (airflow as indicated by arrow direction in FIG. 5).

Figure 6:
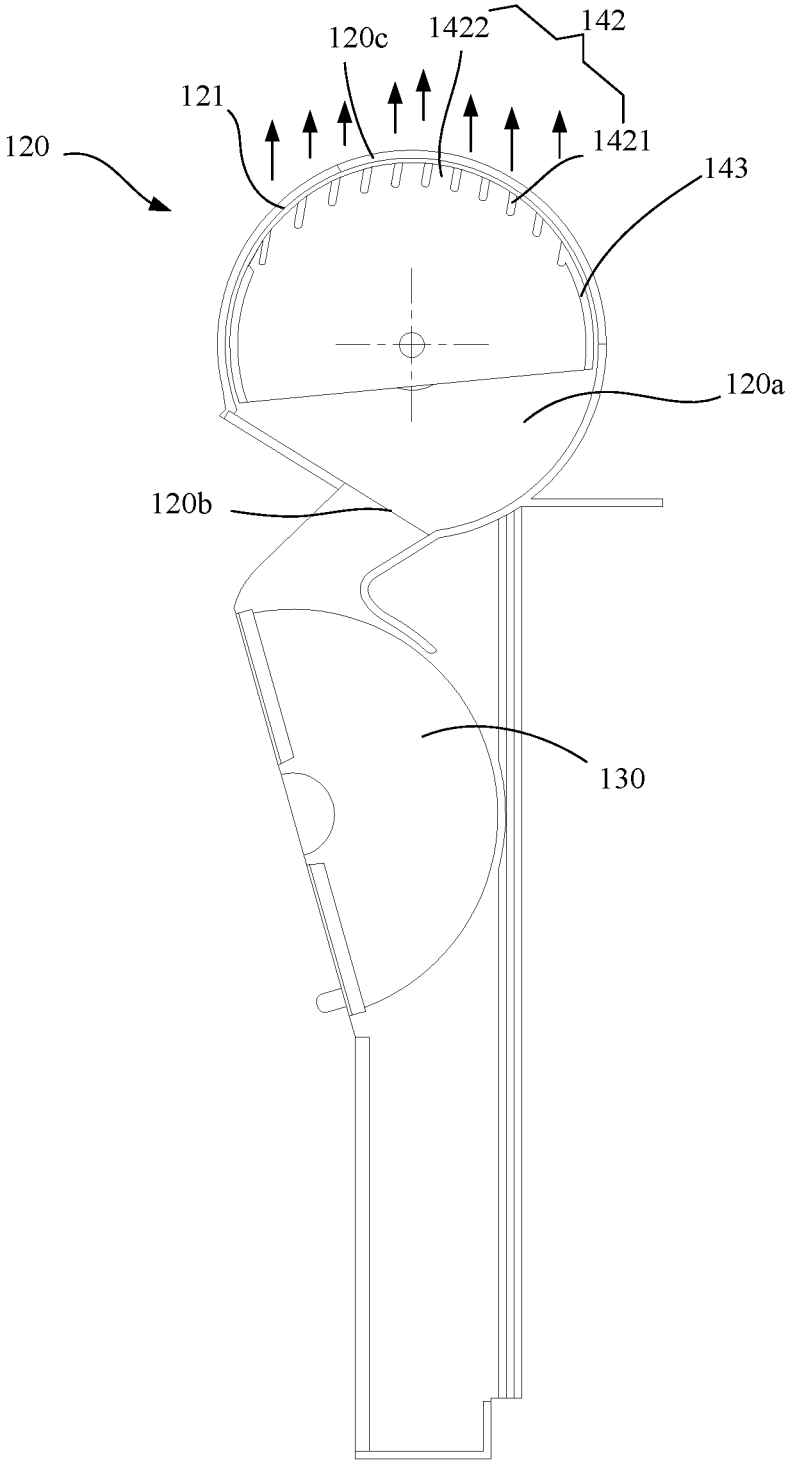
FIG. 6 is a cross-sectional view of the air outlet device of this application in a top air outlet mode.

Please refer to FIG. 6. FIG. 6 is a cross-sectional view of the air outlet device 100 of this application in a top air outlet mode. In this mode, the air guide member 141 is rotated and moved counterclockwise in the figure and moved to a position where the air outlet area 142 is approximately located at a top position of the air outlet 120*c*, and the passages of the air outlet holes 1422 among the grilles 1421 are approximately 90 degrees vertical to the horizontal plane. Because the initial airflow entering the air cavity 120*a* from the air inlet 120*b* is arranged at an acute angle to the horizontal plane and faces the lower part of the air outlet 120*c*, the airflow entering the air cavity 120*a* may be guided through a longer inner wall of the air cavity 120*a* and the direction may change more, so that the energy consumption of the airflow is higher, and the airflow velocity blowing upward from the air outlet 120*c* is slower, which may achieve a windless effect.

It should be noted that although this application describes a scenario in which the included angle between the plate surfaces of the grilles 1421 and the horizontal plane is between 0 degrees and 90 degrees when the air guide assembly 140 moves along the inner surface of the air outlet member 120, for the adjustment of other air outlet angles, based on the solution of this application, it may also be achieved by increasing the opening angle of the air outlet 120*c* or the orientation of the entire air outlet member 120 and then matching the degree of rotation of the air guide assembly 140.

Based on the realization of the above three air outlet modes, in order to make the air outlet angles of these three air outlet modes more accurate, this application further provides a design as follows. Please refer to FIGS. 3 to 6 in combination, each of front and rear sides in a moving direction of the air guide member 141 are provided with a shielding area 143, and the air outlet area 142 is located between the two shielding areas 143. In this application, an area of the air outlet area 142 and an area of the air outlet 120*c* are approximately the same. With the setting of the shielding areas 143 on both sides, opening areas of the air outlet 120*c* close to the bottom part and the top part may be blocked by the shielding areas 143 when the air outlet device 100 is in the top air outlet mode and the front air outlet mode of the above three air outlet modes (refer to FIGS. 4 and 6), so that the air outlet angle is more accurate.

In order to realize that the air outlet device 100 automatically controls the air guide assembly 140 in the above three air outlet modes, the following structural design is carried out in this application. Please refer to FIGS. 1 to 3 in combination again, the air outlet device further includes a driver 150 mounted at an outer side of at least one of the end covers 122. The air guide assembly 140 further includes a connection member 144 connected to an end of the air guide member 141. A driving shaft of the driver 150 is connected to the connection member 144. The driver 150 of this application may be a driving motor. The air guide device may be rotationally connected to an inner wall of the end cover 122 through a pivot on the connection member 144. The driving motor is connected to the pivot on the connection member 144 in transmission, thereby controlling an angle of rotation of the driving motor through a program to achieve the automatic driving of the air guide assembly 140 to stop at the required position in the above modes. Certainly, the mounting position of the driver 150 of this application may also be fixed by means of a structure other than the air outlet device 100.

On the basis that the air outlet device 100 of this application has the functions of realizing the above three air outlet modes, in other embodiments, at least two air outlets 120*c* may be formed at the air outlet member 120, and each air outlet 120*c* may be correspondingly provided with one air guide assembly 140. The figures show the solution in which the air outlets 120*c* are arranged left-right side by side. It can be understood that a number of air outlets 120*c* may be three or more, and they may be arranged left-right side by side or front-rear side by side or a combination of multiple arrangements, and each air guide assembly 140 may be driven and controlled separately by the driver 150, thereby meeting more air outlet angle adjustment requirements, or achieving a new mixed air outlet function through different air outlet modes of different air outlets 120*c*.

Figure 7:
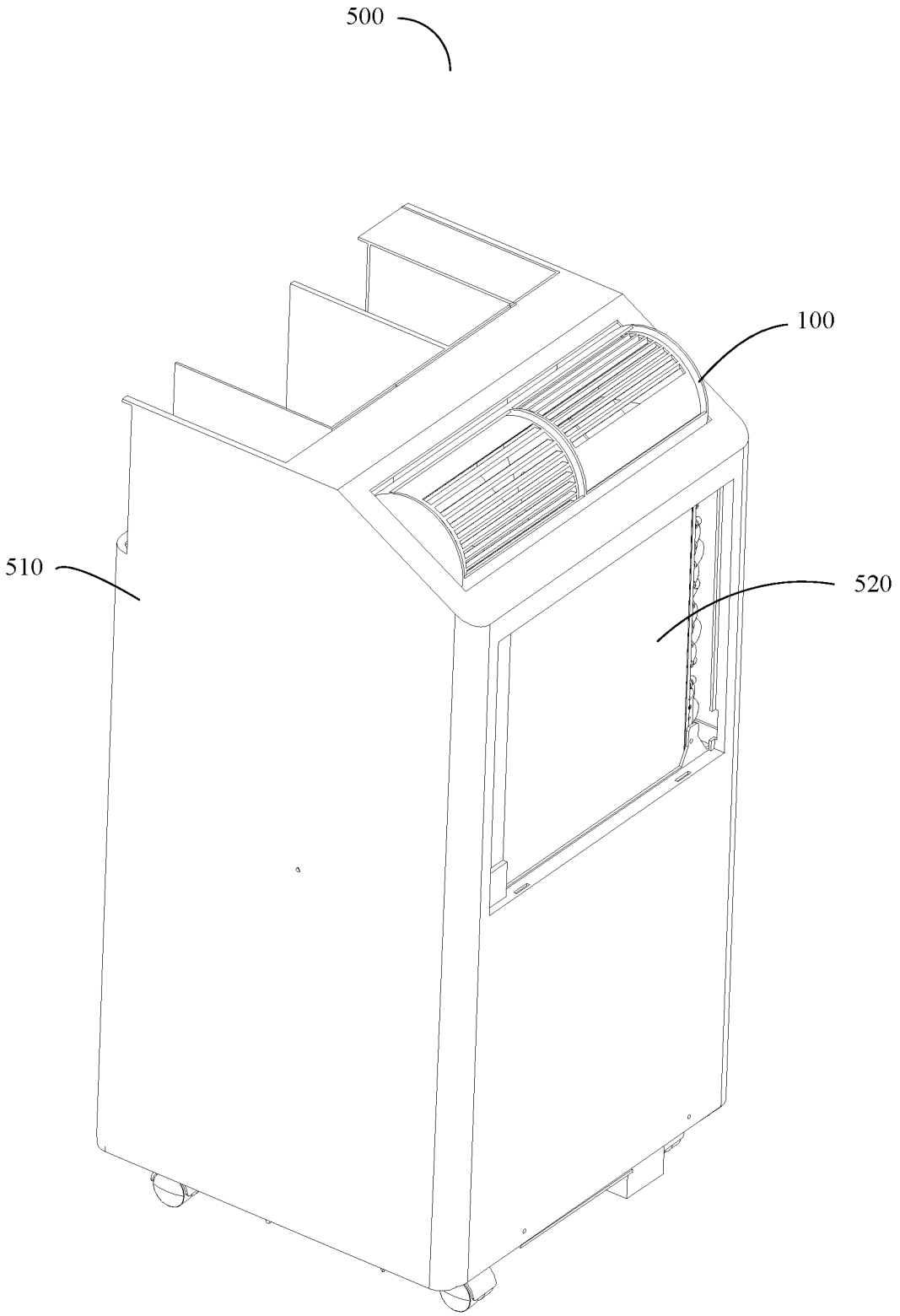
FIG. 7 is a schematic three-dimensional structural diagram of an air conditioning apparatus of this application, in which a pipe structure and a filter in front of an heat exchanger are removed.
Figure 8:
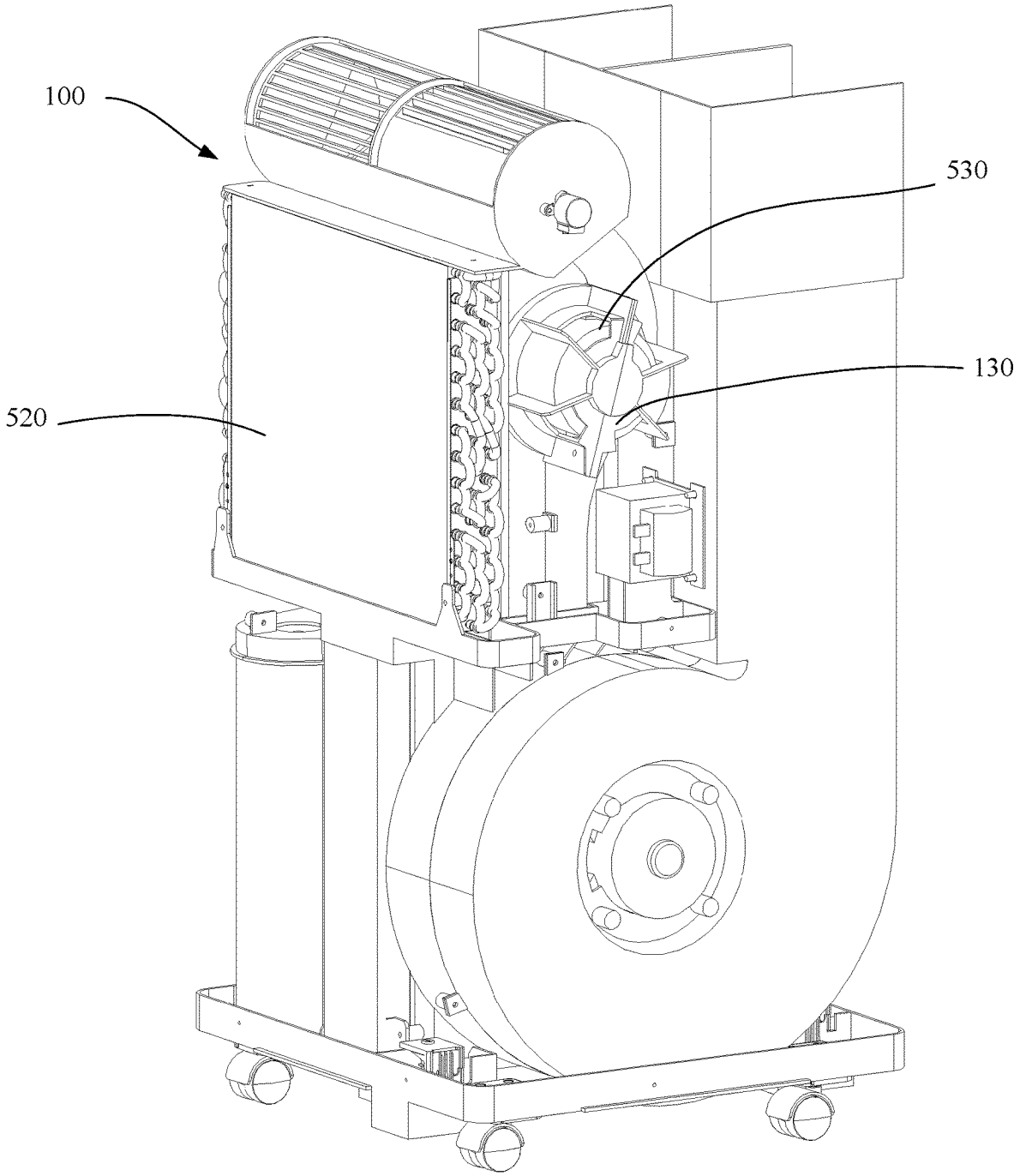
FIG. 8 is a schematic diagram showing an internal structure of the air conditioning apparatus in FIG. 7, in which a housing is removed.

Please refer to FIGS. 7 and 8 in combination, this application further provides an air conditioning apparatus 500. The air conditioning apparatus 500 includes an air blower and the air outlet device 100, and an outlet of the air blower is in communication with the air inlet 120*b*. The specific structure of the air outlet device 100 refers to the above-mentioned embodiment. Since the air outlet device 100 adopts all the technical solutions of all the above-mentioned embodiments, it has at least all the beneficial effects brought by the technical solutions of the above-mentioned embodiments, which will not be repeated here. The air conditioning apparatus 500 may be a mobile air conditioner, an integrated or integral air conditioner, or an air purifier, etc. FIGS. 7 and 8 are examples of the air conditioning apparatus 500 having the above-described air outlet device 100, in which a mobile air conditioner is taken as an example for description.

FIG. 7 is a schematic three-dimensional structural diagram of an air conditioning apparatus 500 of this application, and FIG. 8 is a schematic diagram showing an internal structure of the air conditioning apparatus 500, in which a housing 510 is removed. The air conditioning apparatus 500 includes a housing 510 and a middle partition plate assembly (not labeled) disposed inside the housing 510. The middle partition plate assembly separates the housing 510 into an upper space and a lower space. The upper space is mounted with the air outlet device 100, a heat exchanger 520 and the air blower. In order to simplify an internal structure of the entire mobile air conditioner and save space, in this application, the air duct case 110 of the air outlet device 100 is further provided with a mounting member 130 integrated with the air outlet member 120. The air blower is mounted at the mounting member 130, and the heat exchanger 520 is abutted against the mounting member 130 and covered at an inlet side of the air blower. It can be seen from FIG. 8 that the air outlet member 120 in the air outlet device 100 extends from an opening at a top of the housing 510, and the top of the housing 510 defines an inclined surface to avoid interference with the air outlet of the air outlet device 100. In actual use, the mobile air conditioner with the air outlet device 100 may provide users with the above-mentioned modes of front air outlet, oblique air outlet and top air outlet with multiple air outlet angles, which may provide users with good use experience.

The above are only optional embodiments of this application, and therefore do not limit the patent scope of this application. Under the conception of this application, any equivalent structural transformation made by using the content of the description and drawings of this application, or direct/indirect application in other related technical fields are all included in the scope of this application.

What is claimed is:

1. An air outlet device comprising:

an air duct case including an air outlet member including:

an air cavity formed inside the air outlet member;

an air inlet at one side of the air outlet member and communicating with the air cavity; and at least two air outlets at another side of the air outlet member and communicating with the air cavity;

a driver; and at least two air guide assemblies, each of the at least two air guide assemblies including an air outlet hole, the at least two air guide assemblies being movably mounted at the air outlet member and each located at a corresponding one of the at least two air outlets, the at least two air guide assemblies being provided close to a surface of the air outlet member and being movable along the surface of the air outlet member to change an angle of an airflow from the corresponding one of the at least two air outlets, and the at least two air guide assemblies being driven and controlled separately by the driver.

2. The air outlet device of claim 1, wherein the at least two air guide assemblies are received in the air cavity and movable along an inner surface of the air outlet member, the at least two air outlets being formed at the inner surface of the air outlet member.

3. The air outlet device of claim 2, wherein:

the air outlet member includes:

a curved case with an arched cross-section;

end covers covering two ends of the curved case; and a base plate covering a lateral opening of the curved case;

the at least two air outlets are formed at the curved case;

the air inlet is formed at the base plate; and each of the at least two air guide assemblies includes an air guide member facing the corresponding one of the at least two air outlets, the air outlet hole being formed at the air guide member, and a cross-sectional shape of the air guide member being an arc shape matching a shape of the curved case.

4. The air outlet device of claim 1, wherein:

the air outlet member includes:

a curved case with an arched cross-section;

end covers covering two ends of the curved case; and a base plate covering a lateral opening of the curved case;

the at least two air outlets are formed at the curved case;

the air inlet is formed at the base plate; and each of the at least two air guide assemblies includes an air guide member facing the corresponding one of the at least two air outlets, the air outlet hole being formed at the air guide member, and a cross-sectional shape of the air guide member being an arc shape matching a shape of the curved case.

5. The air outlet device of claim 4, wherein in each of the at least two air guide assemblies, the air guide member includes a shielding area and an air outlet area, and the air outlet hole is formed at the air outlet area.

6. The air outlet device of claim 5, wherein in each of the at least two air guide assemblies:

the air outlet area includes a grille that forms the air outlet hole, the grille extending in a length direction of the air outlet;

an included angle between a direction of the airflow entering the air cavity from the air inlet and a plate surface of the base plate is set to be an acute angle; and an included angle between a plate surface of the grille and a horizontal plane is between 0 degrees and 90 degrees.

7. The air outlet device of claim 5, wherein in each of the at least two air guide assemblies:

the shielding area is one of two shielding areas of the air guide member each provided at one of front side and rear side in a moving direction of the air guide member; and the air outlet area is located between the two shielding areas.

8. The air outlet device of claim 4, wherein each of the at least two air guide assemblies further includes a connection member connected to an end of the air guide member and to a driving shaft of the driver.

9. An air conditioning apparatus comprising:

an air outlet device including:

an air duct case including an air outlet member including:

an air cavity formed inside the air outlet member;

an air inlet at one side of the air outlet member and communicating with the air cavity; and at least two air outlets at another side of the air outlet member and communicating with the air cavity;

a driver; and at least two air guide assemblies, each of the at least two air guide assemblies including an air outlet hole, the at least two air guide assemblies being movably mounted at the air outlet member and each located at a corresponding one of the at least two air outlets, the at least two air guide assemblies being provided close to a surface of the air outlet member and being movable along the surface of the air outlet member to change an angle of an airflow from the corresponding one of the at least two air outlets, and the at least two air guide assemblies being driven and controlled separately by the driver; and an air blower, an outlet of the air blower being in communication with the air inlet.

10. The air conditioning apparatus of claim 9, wherein:

the air duct case further includes a mounting member integrated with the air outlet member; and the air blower is mounted at the mounting member.

11. The air conditioning apparatus of claim 9, wherein the at least two air guide assemblies are received in the air cavity and movable along an inner surface of the air outlet member, the at least two air outlets being formed at the inner surface of the air outlet member.

12. The air conditioning apparatus of claim 9, wherein:

the air outlet member includes:

a curved case with an arched cross-section;

end covers covering two ends of the curved case; and a base plate covering a lateral opening of the curved case;

the at least two air outlets are formed at the curved case;

the air inlet is formed at the base plate; and each of the at least two air guide assemblies includes an air guide member facing the corresponding one of the at least two air outlets, the air outlet hole being formed at the air guide member, and a cross-sectional shape of the air guide member being an arc shape matching a shape of the curved case.

13. The air conditioning apparatus of claim 12, wherein in each of the at least two air guide assemblies, the air guide member includes a shielding area and an air outlet area, and the air outlet hole is formed at the air outlet area.

14. The air conditioning apparatus of claim 13, wherein in each of the at least two air guide assemblies:

the air outlet area includes a grille that forms the air outlet hole, the grille extending in a length direction of the air outlet;

an included angle between a direction of the airflow entering the air cavity from the air inlet and a plate surface of the base plate is set to be an acute angle; and an included angle between a plate surface of the grille and a horizontal plane is between 0 degrees and 90 degrees.

15. The air conditioning apparatus of claim 13, wherein in each of the at least two air guide assemblies:

the shielding area is one of two shielding areas of the air guide member each provided at one of front side and rear side in a moving direction of the air guide member; and the air outlet area is located between the two shielding areas.

16. The air conditioning apparatus of claim 12, wherein each of the at least two air guide assemblies further includes a connection member connected to an end of the air guide member and to a driving shaft of the driver.

* * * * *